United States Patent [19]

Angell

[11] 4,068,784

[45] Jan. 17, 1978

[54] HOLSTER AND SHOULDER-HARNESS ASSEMBLY

[76] Inventor: Robert Angell, 8 Centre Market Place, New York, N.Y. 10013

[21] Appl. No.: 606,591

[22] Filed: Aug. 21, 1975

[51] Int. Cl.[2] ..... F41B 13/04

[52] U.S. Cl. ..... 224/2 B; 224/5 BC

[58] Field of Search ..... 224/2 R, 2 E, 2 F, 5 R, 224/5 H, 5 S, 5 V, 5 P, 2 B, 2 C, 2 D, 5 BC

[56] References Cited

U.S. PATENT DOCUMENTS

| | | | |
|---|---|---|---|
| 1,601,963 | 10/1926 | Arth | 224/2 B |
| 2,037,132 | 4/1936 | Hoyt | 224/2 B |
| 2,109,232 | 2/1938 | Hoyt | 224/2 B |
| 2,443,397 | 6/1948 | Myres | 224/2 B |
| 2,579,782 | 12/1951 | Booth | 224/2 B |
| 3,168,972 | 2/1965 | Parlante et al. | 24/2 B |
| 3,276,646 | 10/1966 | Coggins, Jr. | 224/2 B |
| 3,847,315 | 11/1974 | Bianchi | 224/2 C |

*Primary Examiner*—Robert J. Spar
*Assistant Examiner*—Lawrence E. Willams

[57] ABSTRACT

A holster and shoulder-harness assembly for comfortably suspending a pistol or other instrument adjacent an arm of a wearer in a manner whereby the holster is free to swing and thereby accommodate itself to the contour of the wearer as well as to the demands imposed on the holster when the pistol is withdrawn therefrom. The harness includes a yoke which loops over a shoulder of the wearer and is strapped to the wearer's body, the dependent ends of the yoke having attached thereto the female components of a pair of directional snap fasteners. These compnents are coupled to and rotatable with respect to complementary male components secured at spaced positions on the holster whereby each fastener acts as a pivot and the holster is swingable with respect to the yoke to facilitate withdrawal of the pistol.

4 Claims, 9 Drawing Figures

10
11
12
13
13A
13B
14f
14m
16
17
18
19
20
21
22
23
24
25
26
27

13A
14f
14m
12
12A
22f
10
15m
22m
13B
15f 20
13A
14m
17
18
12
13B
22
21

14
14f
13A 13B
14m
13A
12
10
24

HOLSTER AND SHOULDER-HARNESS ASSEMBLY

BACKGROUND OF INVENTION

This invention relates generally to holster and shoulder-harness assemblies, and more particularly to an assembly in which the harness is firmly anchored to the wearer, wereas the holster coupled to the harness is free to swing relative thereto to facilitate withdrawal of the pistol or other instrument held in the holster.

A holster is a natural or synthetic leather case for a pistol or other small weapon that more or less conforms to the weapon's shape. The design of a holster must take into account two requirements, the first being security. It is vital that the pistol be safely held in the holster so that it remains on the person even under conditions of high activity and is not prone to accidental discharge. The second requirement is quick withdrawal, for when the need arises to put the pistol in action, one must be able to withdraw the pistol from the holster at a desired angle without difficulty.

In order to facilitate quick withdrawal, most holsters have an open mouth, thereby exposing the grip of the pistol and providing immediate access thereto. The remaining structure of the pistol is socketed in the holster so as to hold it securely therein. In general practice, a holster may be worn on the waist, it may be secured to the ankle, or it may be suspended from a shoulder to rest under or adjacent the arm against the body of the wearer. The present invention is concerned primarily with the latter situation, especially since most policemen wear a jacket or other garment which serves to conceal a shoulder holster without interfering with access thereto.

In a typical holster and harness assembly, the harness is constituted by a yoke adapted to rest on one shoulder of the wearer, the yoke being strapped to the body. The dependent ends of the yoke are in strap form and cooperate with buckles attached to the holster. When each of these short straps is buckled in place, a loose end extends therefrom. Hence when the holster is installed under and adjacent an arm, the buckles and loose ends rub against the side of the wearer. This arrangement is often uncomfortable, particularly if the holster is worn for a prolonged period, and it may even become abrasive if the wearer is highly active.

But the more serious objection to the conventional holster and shoulder harness assembly is that once installed on the person, the holster position is immobile and does not accommodate itself to the natural body contour of the person, thereby increasing discomfort. Moreover when the occasion arises to withdraw the pistol, the wearer upon grasping the grip then seeks to swing the holster position to facilitate removal at a desired angle, but this swing is resisted by the holster which is firmly strapped to the harness.

SUMMARY OF INVENTION

In view of the foregoing, it is the main object of this invention to provide a holster and shoulder-harness assembly which may be comfortably and inconspicuously worn in that the coupling of the holster to the harness is free of buckles and loose strap ends, and the holster, because of the nature of its coupling to the harness, tends to assume a position that accommodates the holster and pistol to the natural side contour of the wearer.

More specifically, it is an object of the invention to provide an assembly in which the yoke of the harness which loops over a shoulder of the wearer is coupled at its dependent ends by snap fasteners to the holster, each fastener functioning as a pivot whereby the holster is swingable relative to the yoke. While the use of snap fasteners simplifies the coupling of the holster to the harness, it does not introduce the possibility of accidental decoupling, for the fasteners are directional and decoupling can only be effected by a force imposed at a particular position and in one direction.

A significant feature of the invention is that the swingable holster facilitates withdrawal of the pistol therefrom at a desired angle and does not resist such withdrawal or interfere with rapid action.

Yet another object of the invention is to provide an assembly in which the yoke of the harness is firmly anchored to the body of the wearer regardless of the body dimensions.

Briefly stated, these objects are attained in an assembly whose harness includes a yoke which loops over a shoulder of the wearer, the yoke being strapped to the body so that its position is fixed. The dependent ends of the yoke have attached thereto the circular female components of a pair of directional snap fasteners. These components are coupled to complementary male components which are secured at spaced positions on the holster, the female components being rotatable relative to the male components.

Each fastener acts as a pivot whereby the holster is swingable with respect to the yoke and thereby accommodates itself to the natural contours of the wearer as well as to the demands imposed on the holster when the pistol is withdrawn therefrom. The directional snap fasteners can only be decoupled by a force imposed on the female element in one upward direction, so that the holster cannot be detached from the harness accidentally, but only by a deliberate action.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

Figures 1, 2, 7, 8, 9:
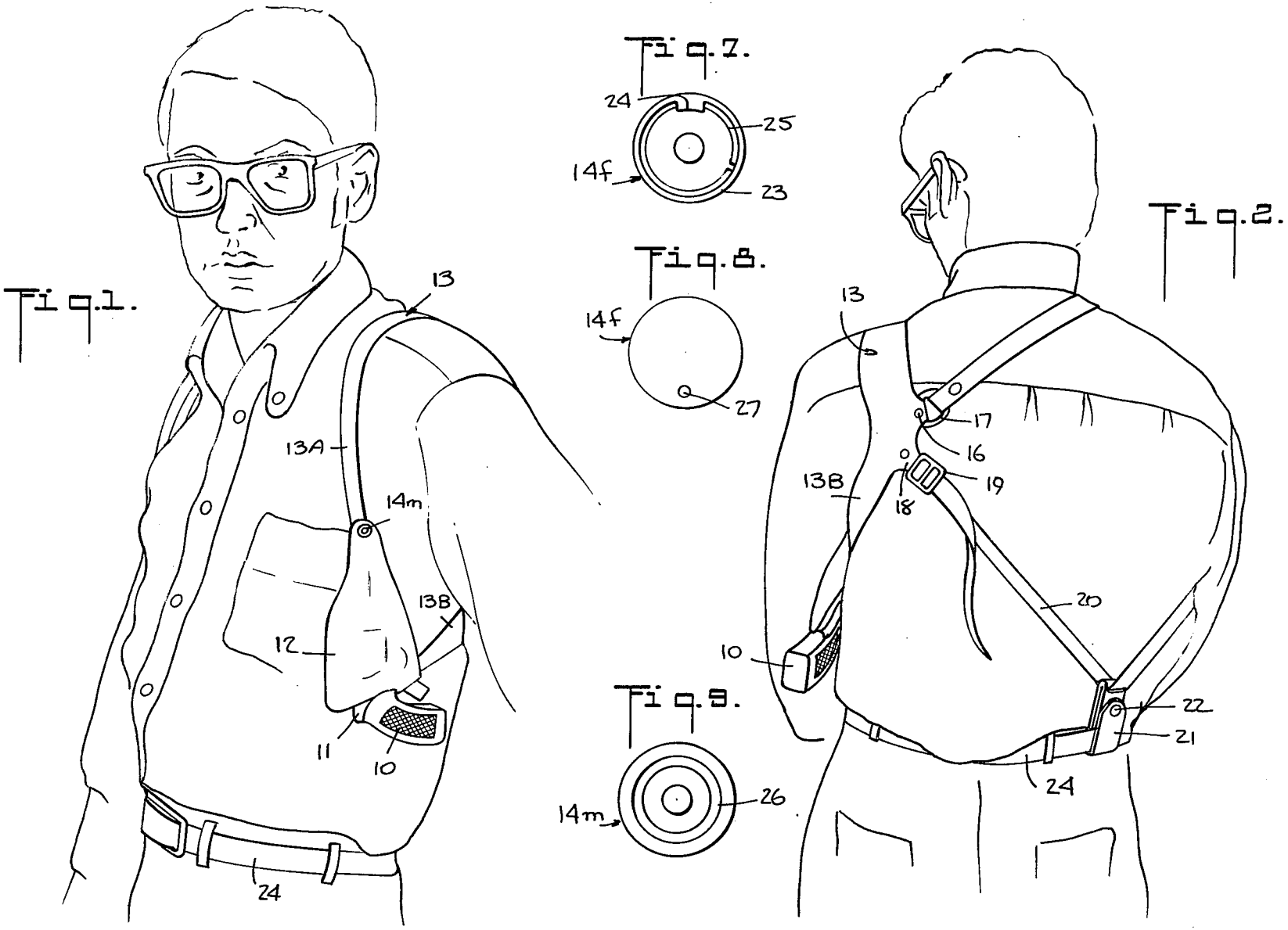
FIG. 1 is a perspective view of a shoulder harness and holster assembly in accordance with the invention, the assembly being illustrated as it appears from the front of the wearer.
FIG. 2 is a perspective view of the assembly as it appears from the rear of the wearer.
FIG. 7 is a plan view of the female component.
FIG. 8 is a rear plan view of the female component.
FIG. 9 is a front plan view of the male component.

Referring now to FIGS. 1 and 2, there is shown an assembly in accordance with the invention, the assembly being illustrated as worn on the left shoulder of a person so that he is able with his right arm to grasp the grip 10 of a pistol 11 held in a holster 12 which lies against the body adjacent the armpit of the left arm. Obviously, for a left-handed person, the holster will be installed adjacent the right arm.

Figures 3, 4, 5, 6:
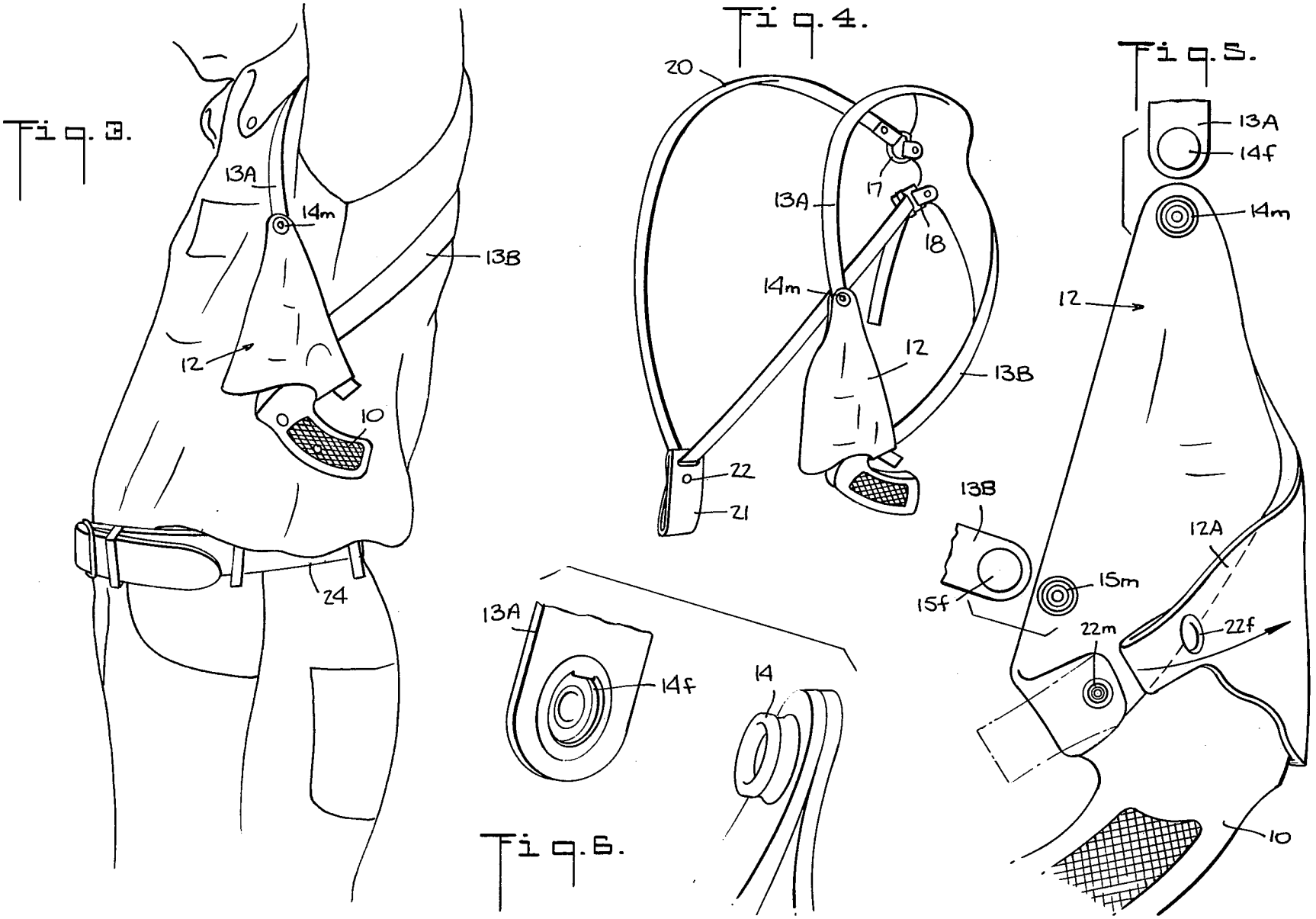
FIG. 3 is essentially the same as FIG. 1 but with the wearer's arm raised to expose the holster position.
FIG. 4 is a view of the holster-harness assembly alone.
FIG. 5 is a view of the holster body.
FIG. 6 shows in perspective the male and female components of the directional fastener.

Holster 12 is suspended from a harness that includes a yoke 13, preferably fabricated of leather or flexible soft plastic material. The yoke is designed to loop over and rest on the shoulder with its opposite ends 13A and 13B falling over the front and rear of the wearer's body. As shown in FIG. 5, secured to the ends of the yoke 13A and 13B are the circular female components **14*f* and 15*f* of a pair of snap fasteners. The male components 14*m* and 15*m* of these fasteners are attached to holster 12 at spaced positions thereon. In practice, instead of attaching female components 14*f* and 15*f*** directly onto the ends of the yoke arm, they may be attached to adjustable strap extensions coupled to the yoke ends so that the pitch of the holster against the body may be set to the desired angle.

In order to firmly anchor the yoke, it is provided with a first lateral tab 16 having a metal ring 17 attached thereto and an adjacent second lateral tab 18 having a buckle 19 attached thereto, as shown in FIGS. 2 and 4. Connected to ring 17 is one end of a fabric strap 20 whose free end passes through buckle 19 and is locked therein at a selected position.

Strap 20 passes through a slot in a belt coupler 21 which is provided with a snap fastener 22 so that the coupler may be linked to a belt 24 worn about the waist, as shown in FIG. 2. Thus in putting on the harness, the yoke is looped over a selected shoulder of the wearer and strap 20, one end of which is held in ring 17, is brought over the other shoulder down over the front of the wearer, then through the slot in belt coupler 21 and finally up over the back of the wearer into buckle 19. The strap may, of course, be adjusted in buckle 19 so that the yoke is tightly held on the shoulder and the holster caused to assume a preferred position.

As shown in FIG. 5, holster 12 is fabricated from a single, profiled piece of leather or flexible sheeting of synthetic plastic material having acceptable characteristics. Holster 12 is provided with a flap 12A to which is attached the female component **22*f* of a snap fastener whose male component 22*m*** is secured to the body of the holster.

It will be seen that one male component **14*m* of the pair of snap fasteners which couple the holster to the harness is located at the nose of the holster, whereas the other male component 15*m*** is located near the mouth thereof. It is to be understood that the invention is not limited to the particular form of holster shown and that other forms may be used in conjunction with the harness, provided that the holster has secured thereto the male components of a pair of snap fasteners in which the female components are rotatable relative thereto, whereby the holster is free to swing with respect to the yoke.

Referring now to FIGS. 7, 8, and 9, there is shown one of the directional snap fasteners composed of female component **14*f* and male component 14*m*. As shown in FIG. 7, the female component is in the form of a cavity whose circular rim 23 is provided at its North position with a small protuberance 24 constituted by a lug which is folded over a split ring 25. The male component 14*m* is provided with a Venturi-shaped tubular projection 26** which is received and latched within the cavity of the female component. In the course of insertion, the split ring is first forced to expand and it then contracts about the throat of the projection to hold it within the cavity.

Because of protuberance 24 at the North position, when the male projection is inserted in the cavity of the female component, the protuberance lies within the throat of the projection, and it is not possible to withdraw the projection except by applying an upward force at the South position of the female component. The South position of the female component is indicated by a small dimple 27 on the head of this component. The female component, though it is rotatable relative to the male component, cannot be disengaged from the male component except by an upward force at the South position. Hence shear forces applied to the components of the fasteners or forces applied at any position other than the South position have no effect on the coupling.

Because each snap fastener which couples the ends of the yoke to the holster acts as a pivot, the holster is free to swing with respect to the yoke and to assume a position adjacent or under the arm of the wearer that depends on the natural contours of the wearer. In other words, the position occupied by the holster will depend on the particular side formation of the person wearing the holster in that the holster, because of its freedom of movement, will find a nesting position against the side to which it naturally conforms. The nesting position is inherently the most comfortable to the wearer.

On the other hand, when the wearer has occasion to withdraw the pistol from the holster, the holster in the course of this action will not resist withdrawal, for it will assume an angle in keeping with the angle of withdrawal, thereby facilitating this action.

While there has been shown and described a preferred embodiment of a pistol or revolver holder and shoulder-harness assembly in accordance with the invention, it will be appreciated that many changes and modifications may be made therein without, however, departing from the essential spirit thereof. For example, the same principle of a holster pivoting on the harness may be applied to a knife holster or to a holster designed for a tool intended for handy withdrawal.

I claim:

1. A holster and shoulder-harness assembly for suspending a pistol in an invested position adjacent an arm of a wearer whereby it is free to swing and thereby accommodate itself to the contour of the wearer as well as to the demands imposed on the holster when the pistol is withdrawn therefrom, comprising:

A. a harness including a yoke which is loopable about a selected shoulder of the wearer, said yoke having dependent ends which extend down opposite sides of the wearer body, and a female component of a snap fastener attached to each end of the yoke, each snap fastener having in addition to said female component a male component and being directional whereby it cannot be decoupled except by a force applied in a predetermined direction at one position of the female component, and B. a holster for suspending said pistol from said harness in an inverted position so that the grip of the pistol normally protrudes from the bottom of the holster, said holster having the male components of the snap fasteners secured thereto at spaced positions to complement said female components on the ends of the yoke, said female components being rotatable relative to the male components to define pivots whereby said holster is free to swing with respect to said harness to facilitate the withdrawal of the pistol at a desired angle, said holster having a triangular formation defining a nose and an opening for receiving the pistol, said pistol being retained in said inverted position in said holster by readily releasable flap means, one of said male components being disposed adjacent said nose and the other of said male components being disposed adjacent said opening.

2. An assembly as set forth in claim 1, further including strap means to secure said yoke to the body of the wearer.

3. An assembly as set forth in claim 2, wherein said wearer is provided with a waist belt and said strap means includes a coupler attachable to the waist belt of the wearer.

4. An assembly as set forth in claim 3, wherein said strap means is formed by a strap connected at one end to a loop secured to a lateral tab on said yoke, said strap passing through a slot in said coupler and terminating in a buckle attached to a second lateral tab on said yoke.

* * * * *